US012077866B2

(12) United States Patent
Baas

(10) Patent No.: US 12,077,866 B2
(45) Date of Patent: Sep. 3, 2024

(54) METHODS AND SYSTEMS FOR PATINATING ZINC SURFACES

(71) Applicant: Koos Jan Baas, Wellington, FL (US)

(72) Inventor: Koos Jan Baas, Wellington, FL (US)

( * ) Notice: Subject to any disclaimer, the term of this patent is extended or adjusted under 35 U.S.C. 154(b) by 416 days.

(21) Appl. No.: 16/296,722

(22) Filed: Mar. 8, 2019

(65) Prior Publication Data

US 2020/0283909 A1 Sep. 10, 2020

(51) Int. Cl.

| | |
|---|---|
| ***C23C 22/68*** | (2006.01) |
| ***C23C 8/02*** | (2006.01) |
| ***C23C 8/06*** | (2006.01) |
| ***C23C 8/10*** | (2006.01) |
| ***C23C 8/16*** | (2006.01) |

(52) U.S. Cl.

CPC ..... *C23C 22/68* (2013.01); *C23C 8/02* (2013.01); *C23C 8/06* (2013.01); *C23C 8/10* (2013.01); *C23C 8/16* (2013.01)

(58) Field of Classification Search

CPC .. C23C 22/68; C23C 8/10; C23C 8/02; C23C 8/16; C23C 8/06

See application file for complete search history.

(56) References Cited

U.S. PATENT DOCUMENTS

2010/0304184 A1* 12/2010 Gall ..... B32B 15/013 428/659
2021/0017652 A1* 1/2021 Mourier ..... C02F 5/10

FOREIGN PATENT DOCUMENTS

WO WO-2017144721 A1 * 8/2017 ..... C23C 2/26

* cited by examiner

*Primary Examiner* — Adil A. Siddiqui

(74) *Attorney, Agent, or Firm* — Derek Fahey; The Plus IP Firm, PLLC

(57) ABSTRACT

A method for patinating zinc surfaces of a structural element. The method includes disposing a structural element with a zinc surface in a container. Disposing an atmosphere around the zinc surface in the container, wherein said atmosphere comprises a carbon-based gas and a relative humidity. Heating the zinc surface for at least one hour to provide a patinated zinc surface. Heating of the zinc surface occurs by disposing the atmosphere at a heating state. The heating state the atmosphere comprises a temperature of at least 50 degrees Celsius, relative humidity of at least 70%, and at least 5% volume of a carbon-based gas.

8 Claims, 7 Drawing Sheets

Table 1: results of patination process with different carbon dioxide concentrations.

| Entry | $CO_2$% | T [°C] | RH [%] | SD | Result |
|---|---|---|---|---|---|
| 1 | atmosphere | 56 | 65 | 15.7 | white rust |
| 2 | 1 | 57 | 67 | 13.9 | Good |
| 3 | 5 | 55 | 54 | 11.3 | very good |
| 4 | 10 | 54 | 50 | 7.0 | very good |
| 5 | 20 | 53 | 60 | 10.2 | very good |

FIG. 7

METHODS AND SYSTEMS FOR PATINATING ZINC SURFACES

CROSS-REFERENCE TO RELATED APPLICATIONS

This application claims the benefit of the filing date of Netherlands Patent Application Serial No. N2022279 titled "METHOD FOR PATINATING ZINC SURFACES AND SYSTEM THEREFOR" and filed Dec. 21, 2018 and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of patinating, and more specifically to the field of patinating of zinc surfaces.

BACKGROUND

Metal surfaces, especially iron and steel surfaces, are known to rust or corrode. Corrosion is the destructive attack of a material by reaction with its environment. Corrosion can also jeopardize safety and inhibit technological progress.

In order to prevent the metal surfaces from rusting and corroding surfaces are often coated. The coating layer can, for example, be coated with another metal, such as zinc, which forms a protective layer. The protective (metal) layer is often reactive and can form a passivation layer which protects the surface.

The naturally occurring process of producing of a protective oxidation layer on a metal layer is known as patination. The process of in which a metal layer forms an artificially induced protective metal oxide layer in order to reduce the chemical reactivity of its surface is called passivation. Stated differently, passivation is artificially induced patination to form a protective oxidation layer on a metal layer. The protective oxidation layer is also known as the patina or passivation layer. It is known that a passivation layer of, for example, zinc requires time to form when the coated surface is exposed to the outside environment. Usually this process takes about 6-10 weeks. This is a disadvantage of exposing the (zinc) coated surface to the outside environment. The passivation of the protective metal layer can also be chemically induced. A disadvantage of chemically induced passivation is that the use of toxic chemicals such as chrome (or chrome comprising compounds). Therefore, such a method is undesired and in many countries the use of chrome (or chrome comprising compounds) is restricted.

The protective layer formed during the passivation process comprises zinc carbonate ($ZnCO_3$) and is referred to as penta zinc hydroxy di-carbonate. Furthermore, the passivation process requires carbon dioxide from the outside environment. The slow process of passivation in an outside environment is a direct consequence of the fact that outside air has low levels of carbon dioxide. The so called 'white rust', which has been known for many decades and appears under moist circumstances in an early stage.

As a result, there exists a need for improvements over the prior art and more particularly for a more efficient way of providing protective layers formed during the passivation process.

SUMMARY

A methods and systems for method for patinating zinc surfaces of structural elements are disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a method for patinating zinc surfaces of a structural element is disclosed. The method includes disposing a structural element with a zinc surface in a container. Next, disposing an atmosphere around the zinc surface in the container, wherein said atmosphere comprises a carbon-based gas and a relative humidity. Heating the zinc surface for at least one hour to provide a patinated zinc surface. The heating of the zinc surface occurs by disposing the atmosphere at a heating state. The heating state the atmosphere comprises a temperature of at least 50 degrees Celsius, relative humidity of at least 70%, and at least 5% volume of a carbon-based gas.

In another embodiment, a system for patinating zinc surfaces is disclosed. The system includes a container. In the closed configuration the container is configured to house a structural element with a zinc surface and an atmosphere. The atmosphere comprises a carbon-based gas and a relative humidity. A gas ingress allows gas to enter the container. An ingress allows carbon-based gases and water vapor to enter the container. A heating element heats the atmosphere within the container, wherein heating the zinc surface for at least one hour provides a patinated zinc surface. Heating of the zinc surface occurs by disposing the atmosphere at a heating state. The heating state comprises a temperature of at least 50 degrees Celsius, humidity of at least 70%, and at least 5% volume of a carbon-based gas.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein:

FIG. 7 is a table showing the results of an experiment performed for patinating surfaces of a structural element; and, FIG. 8 is a block diagram of an example computing device that may be associated with the system and that may be used for controlling the system and processes of the present invention, according to an example embodiment.

DETAILED DESCRIPTION

Figure 1:
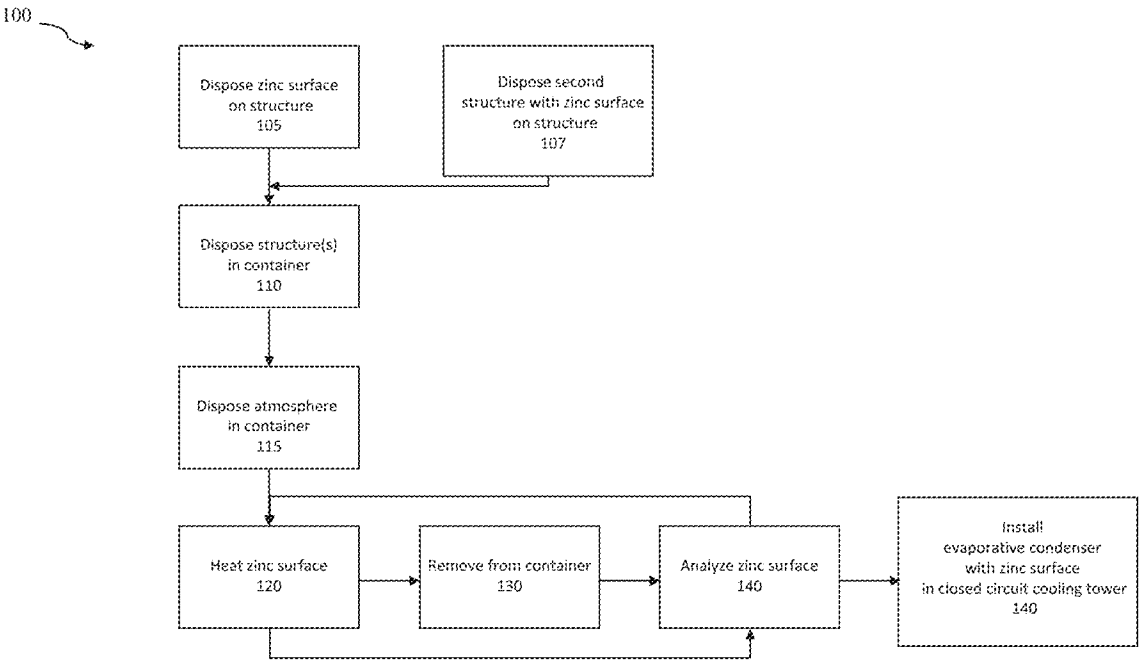
FIG. 1 is a process flow for the methods and systems for patinating zinc surfaces of a structural element, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing methods and system that provide a more efficient way of patinating zinc surfaces, which is providing a protective covering to materials that would otherwise be damaged by corrosion or weathering. The present invention improves over the prior art by providing a much faster way of performing the patinating process. Usually this process takes about 6-10 weeks. However, the present invention may reduce this time to less than four hours. Another advantage of the methods and systems of the invention is that the conditions of the patination process are constant and controlled, which result in the patina layer having a uniform and homogeneous structure. Furthermore, the patina layer produced by the present methods and system provides a reduced number of defects compared to a passivation or patina layer obtained by exposing the zinc surface to the outside environment. Such a more homogeneous layer allows thicker layers of zinc to undergo the patinating process. The present invention provides these advantages by providing methods and systems by having heating conditions of at least 50 degrees Celsius, 70% relative humidity, and using carbon-based gases. Another advantage of the present invention is that the systems and methods used to perform the patination can be performed on site and inside the object of the application. Thus, the structural element is assembled into the object of the intended application and only thereafter patinated.

Referring now to the Figures, FIG. 1 is a process flow 100 for the methods and systems for patinating zinc surfaces of a structural element, according to an example embodiment. Optionally, in some cases, the process begins by first disposing a zinc surface on a structural element. However, in other embodiments, disposing the zinc surfaces on the structural element may occur in the same container as the container in which the patinating process occurs. As a result, maintenance of the zinc surface is more efficient and effective because less assembly (during use) and/or transport is required. This also positively influences the environment as less traveling with parts is required. In step 105, the surface or metal surface of the structural element is initially coated with zinc providing a structural element having a zinc surface. The metal surface may be made from a variety of different types of metals. In one embodiment, the metal surface of the structural element is initially coated with zinc. In some embodiments, the surface for patinating may also include another coating other than zinc. For example, the coating may include copper, bronze, lead, and the like. The process of disposing the zinc (or other metals or alloy) surface on the structural element can be achieved by hot-dipping, electro-galvanization and/or sherardizing.

However, other methods of disposing the zinc layer on the metal surface may be used and are within the spirit and scope of the present invention. The zinc layer is a reactive zinc layer and can form zinc oxide when exposed to oxygen. Zinc oxide will react with water to form zinc hydroxide. Zinc hydroxide reacts with carbon dioxide to form zinc carbonate. The method and systems are also suitable for patinating a (metal) surface having zinc alloy rather than pure zinc. Therefore, the term "zinc surface" used herein may comprise a surface comprising at least zinc. Preferably, in case of a zinc alloy, the content of zinc in the alloy is at least 40 wt %, more preferably the content of zinc in the alloy is at least 60 wt %, even more preferably the content of zinc in the alloy is at least 80 wt %. These metals provide the same effects and advantages as the method according to the invention, the patinated evaporative condenser in a cooling tower according to the invention, the system according to the invention and sensor/analyser according to the invention.

Figure 4:
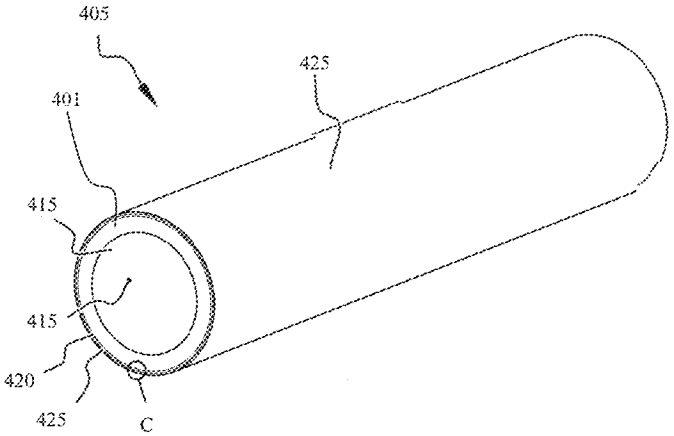
FIG. 4 is a perspective view illustrating a structural element having a zinc surface covered by a patina layer, according to an example embodiment.
Figure 5:
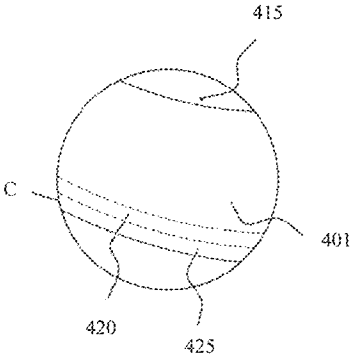
FIG. 5 is an enlarged view of encircled portion C of FIG. 5 illustrating the structural element having the zinc surface covered by the patina layer, according to an example embodiment.

Referring to FIGS. 4. and 5 illustrate a metal structural element 405 having a zinc surface 420 on the outward facing surface of the body 401 of the metal surface structural element. The thickness of the zinc surface on the metal structural element may varied depending on the application. The structural element may be any device that can be used for creating or assembling a variety of different fully assembled products. For example, structural element may be an elongated shaped object, a rod, a pipe, grids, plates, fastener lampposts, post boxes, rain pipe, gutter, pipes, fences, rebar, etc. The structural element may also be a condenser element than may be used in an evaporative condenser, condenser or closed-circuit cooler. The structural elements in a condenser element of an evaporative condenser or closed-circuit cooler may be part of a cooling tower. Besides an evaporative condenser, other structural elements may also include other objects or devices that may be patinated by traditional methods. However, it is understood that other object having metal surfaces may also be used as structural elements and are within the spirit and scope of the present invention.

Optionally, in step 107, the process may also include attaching, arranging or disposing additional structural elements having zinc surfaces to other structural elements having zinc surfaces to form a fully assembled object before moving to step 110 (disposing the structural element with the zinc surface within the container which is further explained below). In other words, the structural element is assembled to other structural elements to assemble a final object prior to the patination steps (further explained below). For example, screws, fasteners, panels and other elements may each have a zinc surface disposed thereon and then assembled into a final object before the final object is patinated by the process and methods descried herein. As a result, 'weak' spots, like connection elements, can be provided with a patination layer without defects. Thus, weak spots of a patinated object may be eliminated. It is known that patinated or coated objects are prone to develop weak spots at connection points where multiple structural elements are attached. Connection means may be for example holes (for screws), screws, nails and the like. Due to the assembly prior to patination, the patinated zinc surface may extend to grooves, holes and surfaces that otherwise would not be exposed to the patinating process. By coating the connection means and other structural elements with zinc prior to patination, patinated surfaces last longer and require less replacement and/or maintenance. Furthermore, the connection means are firmer connected compared to connection means without a zinc coating.

In some cases, the process begins at step 110 by disposing a structural element with a zinc surface in a container, wherein the container has an open configuration and a closed configuration.

In an even further preferred embodiment according to the invention, the method further comprises the step of providing zinc to the metal element prior to the step of providing the structural object prior to the patination process. Providing the zinc surface to the structural element may occur in the same container as the patination process thereby making the entire process more efficient by not having to move the structural element after zinc surface is applied to the structural element. However, it is also feasible that the patination occurs in a different housing than the zinc coating. For instance, the patination may occur on site.

The container is configured to so that the atmosphere with inside the container may be heated. The container may be formed from a variety of different materials including concrete, steel, wood, ceramics, polymer etc. However, it is understood that other types of materials may be also used for forming the container that can house the structural elements and also contain an atmosphere. The container defines an object that is configured to house both structural elements having the zinc surfaces and also contain an atmosphere so that the atmosphere and the contents within the container are heated. In some embodiments, the container may further include shelving, partitions, floors and other structure within the container on which the structural elements having zinc surface may be disposed.

Figure 2:
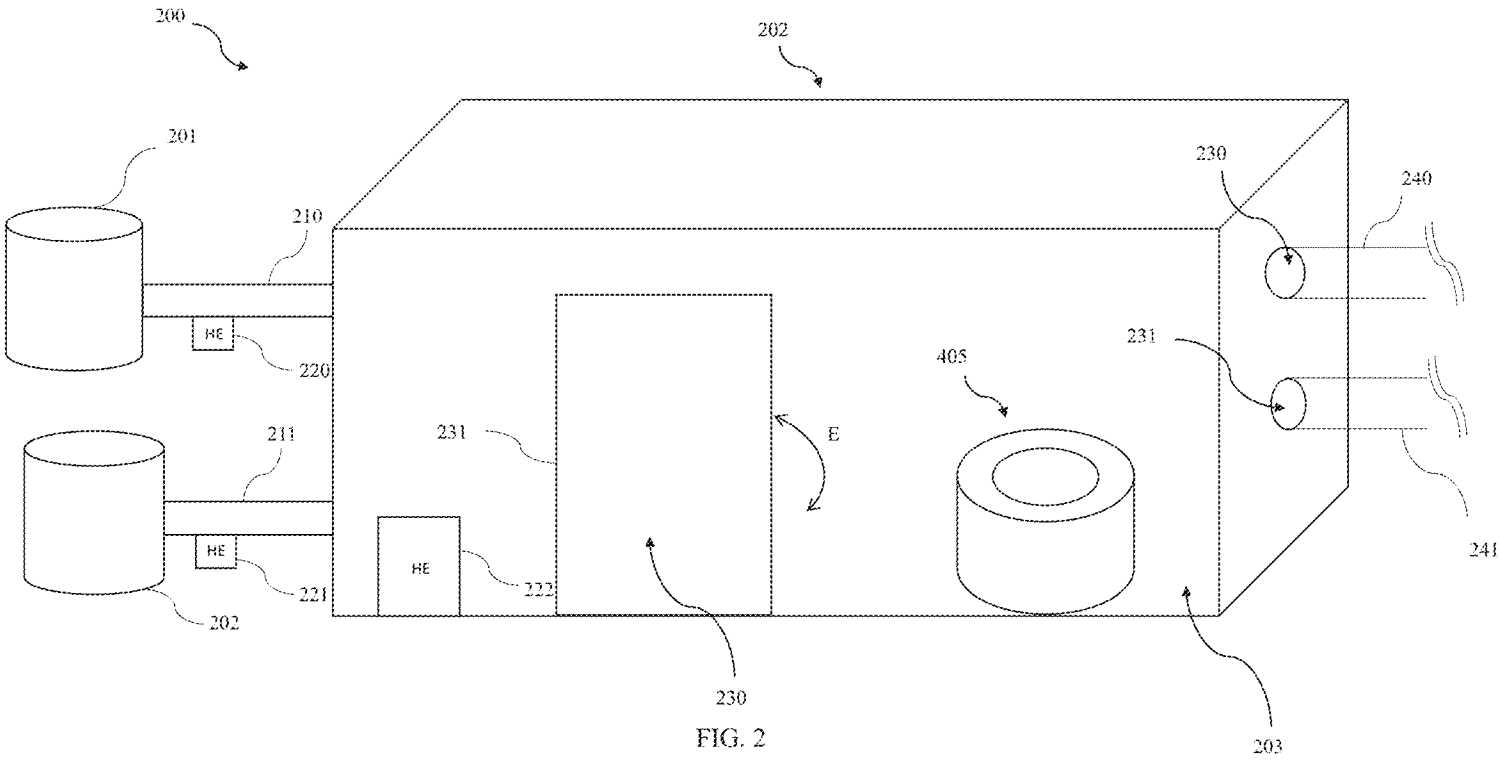
FIG. 2 is a block diagram illustrating the main components of the system for patinating zinc surfaces of a structural element, according to an example embodiment.

FIG. 2 is a block diagram illustrating the main components of the system 200 for patinating zinc surfaces of a structural element 405, according to one embodiment. In one embodiment, the container 202 is configured to have an open configuration and a closed configuration. In the closed configuration, the container is configured to house a structural element with a zinc surface and an atmosphere so that the atmosphere may be heated such that the structural element with zinc surface is also heated. In the present embodiment, container 202 comprises a substantially rectangular shaped body. Container 202 is configured to have within it a structural element having a zinc surface 405 disposed therein. The container preferably forms an enclosure for the atmosphere and is more preferably substantially closed (i.e. except on any ingress and egress). However, in other embodiments, the container has apertures to its environment. In the latter embodiment, it is preferred that carbon-based gas and humidity are continuously added so as to maintain the composition of the atmosphere within a desired range. The structural element may be positioned on a floor, a shelf, or other structure within the container. The container may also have a plurality of different shapes and sizes. For example, in other embodiments, the shape of the container may be triangular, circular, polygon shaped etc. However, other shapes may also be used in or within the spirit and scope of the present invention. A variety of different size containers may also be used. For example, the container may be the size of a single room, the size of the warehouse, the size of a small box etc. The dimensions of the container may be adjusted for the dimensions of the dimensions of the structural elements that are disposed within the container. Additionally, the container may also include seals, closures and other devices that allow the atmosphere within the container to be contained and also to be heated (further explained below). In other embodiments, the container may be a portion of the structural element itself. For example, if the structural element is a tubular shaped body, then the container may be the cavity within the tubular shaped body. In the present invention, the container may also include an entrance 230 that provides access to inside 203 the container. The entrance may be configured to have dimensions so that the structural elements having zinc surfaces may be moved from inside the container to outside of the container through the entrance. It is also understood that multiple entrances may also be used and are within the spirit and scope of the present invention. The entrance may also have a closure 231 that is configured to close the entrance and seal the atmosphere and other objects within the container. In the present embodiment, the closure 231 is a door that is hingedly attached and configured to open and close along curved line E. However, it is understood that other types of closures may also be used to block entrance such that the entrances are sealed so that the atmosphere and objects within the container may be heated.

In one embodiment, the entire structural element with a zinc surface is disposed in a container when the entire structural element is within the container. In other embodiments, structural elements can be disposed within the container when only a portion of the structural element is inside the container. In such embodiments, gaskets and seals may seal the portion of the structural element having been zinc element inside the container so that the atmosphere may be heated (further explained below).

An ingress is also included for allowing carbon-based gases and water vapor to enter the container. It should also be noted that the ingress for water vapor and the ingress for the carbon-based gases may be a single egress, multiple separate egresses (as illustrated in FIG. 2) or multiple egresses that allow each carbon-based gases and water vapor to enter the container. A first tank 201 is configured to have carbon-based gases stored within the first tank. The first tank is in fluid communication via conduit 210 with the inside or interior portion 203 of container 202. The gas ingress allows the carbon-based gas stored inside the first tank to move from the first tank into the inside of the container. A heating element 220 may be positioned with the system so that the carbon-based gases may be heated before the carbon-based gases enter the container. Additionally, or alternatively, a heating element 222 may also be included to heat the atmosphere from inside the container. A second tank 202 is configured to have water vapor, or other forms thereof, stored within the second tank. The second tank is in fluid communication via conduit 211 with the inside 203 of container 202. The water vapor ingress allows water vapor or water stored inside the first tank to move from the second tank into the inside of the container. A heating element 221 may be positioned with the system so that water vapor may be heated before water vapor enters the container. Additionally, or alternatively, a heating element 222 may also be included to heat the atmosphere from inside the container.

In one embodiment, the system is configured for also having at least one egress for allowing water vapor and carbon-based gases to exit the system. It should also be noted that the egress for water vapor and the egress for the carbon-based gases may be a single egress, multiple separate egresses (as illustrated in FIG. 2) or multiple egresses that allow each carbon-based gases and water vapor to enter the container. In other embodiments, no specific egress may be used and instead the water vapor and carbon-based gases for exiting the system via the entrances. In the present embodiment, conduit 240 is attached to the opening 230 and is configured for allowing at least one of the carbon-based gas and water vapor to exit the system. Additionally, a second conduit 241 may also be attached to an opening 241 for also allowing at least one of the carbon-based gas and the water vapor to exit the system. Conduits 240, 241 may also be in fluid communication with other tanks and containers for storing the gases and water vapor or water.

Figure 3:
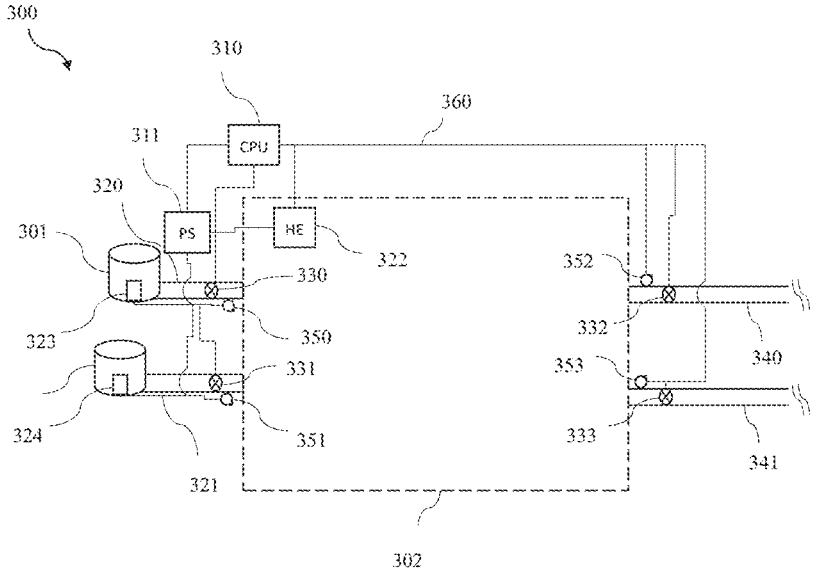
FIG. 3 is a block diagram illustrating the main electrical components of the system for patinating zinc surfaces of a structural element, according to an example embodiment.

FIG. 3 is a block diagram illustrating the main electrical components of the system for patinating zinc surfaces of a structural element, according to an example embodiment. The main electrical components of the system in electrical communication with each other via conductors 360. The container is represented by hashed line 302. A central processing unit 310 is configured for controlling the flow of water vapor and carbon-based gases into the container. The central processing unit may include a computing device, such as embodied in FIG. 8. In the present embodiment, tanks or storage containers 301, 302 are configured for storing either the carbon-based gases or water vapor and are in fluid communication with the inside of the container. Heating elements 322, 323, 324 are configured for heating the atmosphere within the container. As illustrated in FIGS. 2 and 3 the heating elements may be either within the container, along the conduits or in other locations that provide heated carbon gates gases and water vapor. A power supply or power source 311 may also be in electrical communication with the heating elements and other electrical components within the system. Additionally, pumps and other apparatus may also be used for moving the water vapor and carbon-based gases into the container. Sensors 350, 351, 352, 353 are in electrical communication with the central processing units may be used for providing information to the central processing unit for controlling the system. The sensors may include sensors for determining the level of carbon-based gas within the atmosphere with inside the container, sensors for determining relative humidity, sensors for determining temperature, sensors for determining gas flow, as well as many other types of information. For example, each sensor may be a sensor configured for measuring different gas concentrations and/or for measuring the humidity in the housing. Valves 330, 331, 332, 333 are in electrical communication with the central processing units may be used for controlling the flow of water vapor and gases. It is understood that additional or less amounts of sensors and valves may be used. The valves and sensors provide the advantage of measuring and adjusting the relative humidity and carbon-gas concentration with the container. This will result in a well-defined and stable climate which is required to form a uniform and/or homogeneous patina layer and effective patination.

Referring to FIGS. 1 and 2, next in step 115, an atmosphere is disposed around the zinc surface of the structural element 405 in the container 203 in the closed configuration. The atmosphere includes the carbon-based gases and water vapor that is pumped or is moved into the container. The carbon-based gas may have a gas concentration of approximately 10% by volume, Additionally, most preferably the carbon-based gas concentration may have a gas concentration of at least 25% by volume. Contrary to conventional methods for providing a patina layer to a zinc surface is that the zinc surface is provided with a carbon-based gas with a concentration of at least 5% by volume. This will help to increase the speed of the patinating process. As a result, the patinating process is not limiting the chain from manufacturer to end user.

An advantage of using higher concentrations of the carbon-based gas in the system and methods is that the higher concentrations of carbon-based gases accelerate the formation of zinc carbonate, and even the highly desired penta zinc hydroxy di-carbonate ($Zn_5(CO_3)^2$—$X\cdot(OH)^6$+2X or PZHC), with X as specified above. As a result, the production time of patinated metal surfaces decreases. Therefore, delivery of objects with a patinated metal surface to potential customers is reduced. The carbon-based gas may be carbon dioxide, carbon monoxide, or a mixture thereof. Most preferably wherein the carbon-based gas is carbon dioxide. The carbon-based gas can form zinc carbonate. Preferably carbon dioxide, carbon monoxide or a mixture thereof is used to form zinc carbonate. This results in an effective protection of the metal surface. Furthermore, carbon monoxide and carbon dioxide are readily available and are efficient reagents to form zinc carbonate. Carbon dioxide is preferred over carbon monoxide or a mixture of carbon monoxide and carbon dioxide. Carbon dioxide is readily available and is less toxic/harmful at high concentrations compared to carbon monoxide.

The amount of water vapor may be controlled by the system. The water vapor in the system may be adjusted so that the relative humidity (RH) of the atmosphere within the container is adjusted. In certain embodiments, the carbon-based gas and humidity are continuously added to maintain the composition of the atmosphere within a desired range so that the heating state for heating the structural element is controlled.

In other embodiments, patination can be performed on site and inside the object of the application. As mentioned above, the entire object may be concealed within the container. Alternatively, the container may be an external enclosure of the object itself. In other words, the container may be formed by the structural element having the zinc surface, then an atmosphere formed by the structural element is heated to patinate the surface of the structural element. For example, if the structural element is a tubular shaped body, then the container may be the cavity within the tubular shaped body. The zinc surface within the cavity of the structural element may be heated to provide the patinated zinc surface. The 'weak' spots, like connection elements, can be provided with a patination layer without defects.

Next, the process moves to step 120. In step 120 the system is configured for heating the zinc surface for at least one hour to provide a patinated zinc surface. The heating of the zinc surface occurs by disposing or arranging the atmosphere at a heating state. By arranging the atmosphere to the heating state, it causes the structural element with zinc surface to be heated as well. At the heating state, the atmosphere comprises a temperature of at least 50 degrees Celsius, relative humidity of at least 70%, and at least 5% volume of a carbon-based gas.

An advantage of the method according to the invention is that the applied heat is at least 50° C. and will accelerate the forming of zinc carbonate. As a result, a relatively short period of time is required to form a zinc carbonate layer. Thus, the time to patinate the zinc coated surface is significantly decreased and is no longer a limiting factor in the production process of patinated zinc surfaces. Additionally, another advantage of the method and systems according to the invention is that the humidity is at least 70% and will accelerate the forming of zinc carbonate. As a result, zinc oxide can react to form zinc hydroxide, wherein the reaction is not limited to the availability of water. A further advantage of the method according to the invention is it provides a patina layer with a uniform and homogeneous structure. Furthermore, the patina layer comprises a reduced number of defects compared to a passivation or patina layer obtained by exposing the zinc surface to the outside environment. As a result of the more homogeneous layer a thicker layer comprising zinc carbonate, such as PZHC, can be formed. Therefore, the patina layer provided to the metal surface has a longer lasting protection.

As mentioned above, heating elements may be used to heat the carbon gas, water vapor and adjust the temperature of the resulting atmosphere inside the container. The heating element may be inside the container or also may be at various locations within the system. The heating element may comprise be a device that converts one form of energy or matter to thermal energy. The heating element may be a polymer heating element, composition heating elements, a metal heating element, combination heating element etc. Additionally, the thermal energy needed may be provided by burning fuel, such as propane, wood, coal or other medium to produce thermal energy.

In certain embodiments, the heating state occurs at a temperature of at least 60° C., preferably the heating occurs at a temperature of at least 70° C., and more preferably the heating occurs at a temperature of at least 80° C. Performing the heating at a temperature of at least 60° C., preferably a temperature of at least 70° C., more preferably a temperature of at least 80° C. results in a stable patination and thus a patina layer with a uniform and homogeneous structure. Furthermore, the heat vaporizes the water which is released in the patination process. The vaporized water will then contribute to the humidity level. In an even further preferred embodiment according to the invention, the humidity is at least 75%, preferably the humidity is at least 78%, more preferably the relative humidity is at least 80%. An advantage of the methods and systems is that a humidity level of at least 75%, preferably of at least 78%, more preferably of at least 80% accelerates the formation of zinc hydroxide. As a result, the patination process is not limited to the formation of zinc hydroxide and thus an efficient method for patinating a zinc surface is achieved.

In one embodiment, the heating of the zinc layer of the structural element occurs for at least two hours, preferably the heating occurs for at least three hours, more preferably the heating occurs for at least four hours. By further preference the heating occurs for at most ten hours. An advantage of the methods according to the invention is that heating the zinc coated surface accelerates the formation of zinc carbonate. Furthermore, the heat provides in a stable humidity level. As a result, an efficient, controlled and effective patination method is achieved.

The chemical reaction performed in the patination process follows for example the reactions as shown below, wherein Zn is zinc, $O_2$ is oxygen, ZnO is zinc oxide, $Zn(OH)_2$ is zinc hydroxide, $CO_2$ is carbon dioxide, $H_2O$ is water and $ZnCO_3$ is zinc carbonate:

$$2Zn+O_2 \rightarrow 2ZnO$$

$$ZnO+H_2O \rightarrow Zn(OH)_2$$

$$Zn(OH)_2+CO_2 \rightarrow H_2O+ZnCO_3$$

In a most preferred embodiment according to the invention, the formed patina layer as penta zinc hydroxy dicarbonate ($Zn_5(CO_3)^2$—$X\cdot(OH)^6$+2X or PZHC) and is a tight protection outer layer which reduces or overcomes corrosion, wherein X is $0 \leq X \leq 2$, preferably wherein X is $0 \leq X \leq 1$, or even wherein X is $0 \leq X \leq 0.5$. FIG. 4 illustrates the patina layer 425 formed over the zinc layer 420 on the structural component 415.

Figure 6:
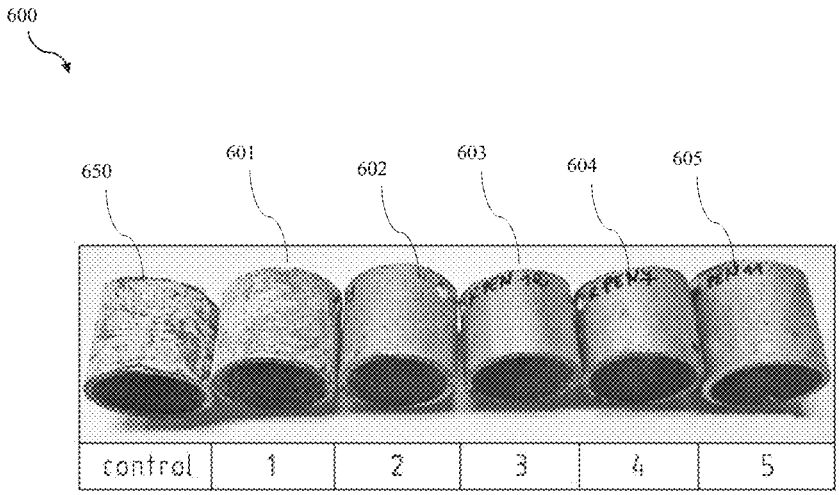
FIG. 6 are illustrations illustrating exposed structural elements having different carbon dioxide concentrations, according to an example embodiment.

FIG. 6 are illustrations illustrating exposed structural elements having different carbon dioxide concentrations, according to an example embodiment. FIG. 6 illustrates the results 600 of experiments that were performed with the methods and systems of the invention. FIG. 6 illustrates the experiments for structural elements having a steel surface, each which is zinc coated and was patinated except for the structural element 650. Each structural element is a zinc coated steel pipe having a diameter of about 2.5 centimeters and a length of about 2.5 centimeters. The zinc surface of structural element was exposed to different carbon dioxide concentrations at a temperature between 53° C. and 57° C. for approximately three hours. The relative humidity was determined every 30 minutes. The resistance to corrosion was determined by exposing the surface to a saturated oxygen solution of 150 mg Cl—/L for 24 hours. The results of the experiment are shown in FIG. 7. In FIG. 7 the term "$CO_2$%" is the carbon dioxide concentration, the term "T" is the temperature in degrees Celsius (° C.), the term "RH" is relative humidity, the term "SD" is the standard deviation of RH, and result is the overall results of the pipes exposed to corrosion. Increasing the concentration of carbon dioxide shows good patination of the zinc surface, and thus protection against corrosion. Concentrations above 20% of carbon dioxide were considered undesired as high concentrations of carbon dioxide are hazardous, and not cost effective. It is shown that a concentration of at least 5% carbon dioxide provides the zinc coated metal surface with a very good patina layer. This will result in a longer lasting protection for corrosion. In a further experiment performed with the methods according to the invention, steel pipes were exposed to the conditions mentioned in table 1 (FIG. 7). Thus, control pipe 650 exposed to a gas without any carbon dioxide, pipe one 601 was exposed to a carbon dioxide concentration present in outside air, pipe two 602 was exposed to a gas with a carbon dioxide concentration of about 1%, pipe three 603 was exposed to a gas with a carbon dioxide concentration of about 5%, pipe four 604 was exposed to a gas with a carbon dioxide concentration of about 10%, and pipe five 605 was exposed to a gas with a carbon dioxide concentration of about 20%. Based on the results, it becomes clear that a severe, efficient and effective patination layer is formed on the zinc coated surface of the pipes. The experiments clearly show the advantageous effects achieved with the method and system of the invention.

Next, optionally, in step 130, after a certain amount of time, the structural element having the patination layer may be removed from the container. Next, in step 140 the zinc surface and/or patination layer may be analyzed. In certain embodiments, the step of analyzing the patination layer may occur at the same time or while the patination process is occurring so that the structural element having the zinc surface may be analyzed while the structural element is still within the container thereby eliminating the step of having to remove the structural element within the container. An advantage of analyzing the patinated surface provides information about the quality, such as conciseness, homogeneity, packing and/or uniformity of the patina layer. This results in a good knowledge of the patina layer, for example where the weak spots are. Another advantage of analyzing these structural elements having the patination layer is that the quality and/or thickness of the patina layer can be analyzed. This results in a predictability of maintenance and thus in a longer lasting patina layer and/or patinated surface.

Next, optionally, an evaporative condenser coil with a zinc surface may be used in a closed-circuit cooling tower. The evaporative condenser coil may include components having steel, zinc, and zinc carbonate. The evaporative condenser coil may be patinated by the method according to the invention. The patinated evaporative condenser coil is in a closed circuit cooling tower and may provide the same effects and advantages as the method according to the invention. Furthermore, there has been a long felt need for an evaporative condenser coil with long lasting anti-corrosion effect. Besides an evaporative condenser coil other objects can be patinated, including but not limited to, all the objects patinated and/or passivated by traditional methods. For example, but not limited to, lampposts, post boxes, rain pipe, gutter, pipes, fences, concrete braiding, and the like. Another benefit of the present invention is that patinating zinc surfaces can be performed on site.

Figure 8:
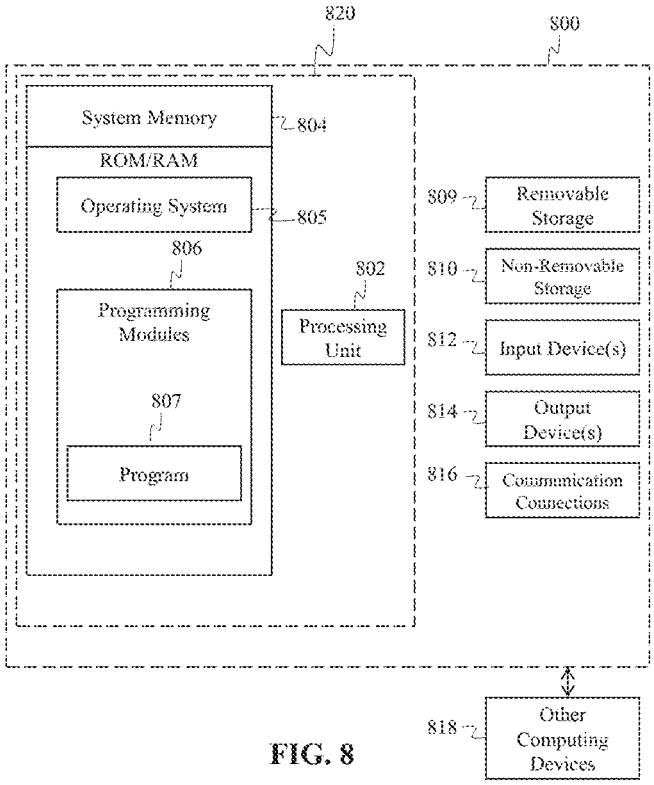

FIG. 8 is a block diagram of an example computing device that may be associated with the system and that may be used for controlling the system and processes of the present invention. Consistent with the embodiments described herein, the aforementioned actions performed by central control unit or central processing unit 310 may be implemented in a computing device, such as the computing device 800 of FIG. 8. Any suitable combination of hardware, software, or firmware may be used to implement the computing device 800. The aforementioned system, device, and processors are examples and other systems, devices, and processors may comprise the aforementioned computing device. Furthermore, computing device 800 may comprise an operating environment for the method and process shown in FIG. 1 above.

With reference to FIG. 8, a system consistent with an embodiment of the invention may include a plurality of computing devices, such as computing device 800. In a basic configuration, computing device 800 may include at least one processing unit 802 and a system memory 804. Depending on the configuration and type of computing device, system memory 804 may comprise, but is not limited to, volatile (e.g. random access memory (RAM)), non-volatile (e.g. read-only memory (ROM)), flash memory, or any combination or memory. System memory 804 may include operating system 805, one or more programming modules 806 (such as program module 807). Operating system 805, for example, may be suitable for controlling computing device 800's operation. In one embodiment, programming modules 806 may include, for example, a program module 807. Furthermore, embodiments of the invention may be practiced in conjunction with a graphics library, other operating systems, or any other application program and is not limited to any particular application or system. This basic configuration is illustrated in FIG. 8 by those components within a dashed line 820.

Computing device 800 may have additional features or functionality. For example, computing device 800 may also include additional data storage devices (removable and/or non-removable) such as, for example, magnetic disks, optical disks, or tape. Such additional storage is illustrated in FIG. 8 by a removable storage 809 and a non-removable storage 810. Computer storage media may include volatile and nonvolatile, removable and non-removable media implemented in any method or technology for storage of information, such as computer readable instructions, data structures, program modules, or other data. System memory 804, removable storage 809, and non-removable storage 810 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 800. Any such computer storage media may be part of device 800. Computing device 800 may also have input device(s) 812 such as a keyboard, a mouse, a pen, a sound input device, a camera, a touch input device, etc. Output device(s) 814 such as a display, speakers, a printer, etc. may also be included. The aforementioned devices are only examples, and other devices may be added or substituted.

Computing device 800 may also contain a communication connection 816 that may allow device 800 to communicate with other computing devices 818, such as over a network in a distributed computing environment, for example, an intranet or the Internet. Communication connection 816 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 804, including operating system 805. While executing on processing unit 802, programming modules 806 may perform processes including, for example, one or more of the methods shown in FIG. 1 above. Computing device 802 may also include a graphics processing unit 803, which supplements the processing capabilities of processor 802 and which may execute programming modules 506, including all or a portion of those processes and methods shown in FIG. 2 above. The aforementioned processes are examples, and processing units 802, 803 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A method for patinating at least one zinc surface of a structural element, wherein the method consists of:

disposing the structural element with the at least one zinc surface in a container comprising at least two ingresses for allowing an atmosphere to enter the container, the at least two ingresses comprising a gas ingress for allowing gas to enter the container and a water vapor ingress for allowing water vapor to enter the container;

disposing the atmosphere around the at least one zinc surface in the container, wherein the atmosphere comprises a carbon-based gas and a relative humidity;

heating the at least one zinc surface for greater than one hour to provide a patinated zinc surface;

wherein heating the at least one zinc surface comprises controlling the atmosphere at a heating state, wherein the controlled atmosphere comprises maintaining a temperature of at least 50 degrees Celsius, maintaining a relative humidity of at least 70%, and maintaining at least 5% by volume of a carbon-based gas; and providing a patina layer having a uniform and homogeneous structure comprising penta zinc hydroxy di carbonate having a structural formula of $(Zn_5(CO_3)_2 \cdot (OH)^-_6)$.

2. The method of claim 1, wherein the carbon-based gas comprises at least one of carbon dioxide, carbon monoxide, and a combination of carbon dioxide and carbon monoxide.

3. The method of claim 1, wherein the carbon-based gas concentration of the atmosphere is at least 25% by volume.

4. The method of claim 1, wherein the heating state has a temperature of at least 80 degrees Celsius.

5. The method of claim 1, wherein the heating state has the relative humidity of at least 80%.

6. The method of claim 1, wherein the heating occurs for at least four hours.

7. The method of claim 1, wherein the at least one zinc surface is disposed on the structural element prior to disposing the structural element within the container.

8. The method of claim 1, wherein the structural element in the container with the at least one zinc surface is at least one of an evaporative condenser and a closed-circuit cooling tower.

* * * * *